US005159974A

United States Patent [19]

Victory, Jr.

[11] Patent Number: 5,159,974

[45] Date of Patent: Nov. 3, 1992

[54] STEAM CONDENSER WITH ARTICULATED ELECTRICALLY HEATED BLANKETS OR PANELS

[75] Inventor: Sidney P. Victory, Jr., Katy, Tex.

[73] Assignee: Hudson Products Corporation, Houston, Tex.

[21] Appl. No.: 817,196

[22] Filed: Jan. 6, 1992

[51] Int. Cl.[5] ..... F01P 7/10; F28B 11/00

[52] U.S. Cl. ..... 165/96; 165/39; 165/98; 219/528

[58] Field of Search ..... 165/39, 96, 98, 99, 165/900; 219/528, 529

[56] References Cited

U.S. PATENT DOCUMENTS

| | | | |
|---|---|---|---|
| 2,745,942 | 5/1956 | Cohen | 219/528 |
| 3,417,229 | 12/1968 | Shomphe et al. | 219/528 |
| 3,716,097 | 2/1973 | Kelp et al. | 165/39 |
| 3,854,459 | 12/1974 | Stimeling | 165/39 |
| 4,275,831 | 6/1981 | Smith | 165/39 |
| 4,450,899 | 5/1984 | Jakobsson et al. | 165/39 |

FOREIGN PATENT DOCUMENTS

| | | | |
|---|---|---|---|
| 3405107 | 8/1985 | Fed. Rep. of Germany | 165/98 |
| 3701584 | 8/1988 | Fed. Rep. of Germany | 165/98 |

*Primary Examiner*—John Rivell
*Assistant Examiner*—L. R. Leo
*Attorney, Agent, or Firm*—Robert J. Edwards

[57] ABSTRACT

A steam condenser with temperature regulating apparatus including an exposed surface of the condenser defining an upper portion and a lower portion for allowing outside air to come into contact with the condenser. A heating control mechanism is connected to the condenser at the upper portion of the exposed surface and utilizes articulated electrically heated blanket or electrically heated panels in order to provide a freeze-proof environment and efficient operation of the steam condenser.

13 Claims, 6 Drawing Sheets 54
52
10
46
38
60
38
38
38
34
34
34
34
62
62
62
34
34
34
62
62
30
62
30
66
66
66
34
34
2
62
62
62
16
70
70
70
30
32
32
30
26
26
26
40
10

STEAM CONDENSER WITH ARTICULATED ELECTRICALLY HEATED BLANKETS OR PANELS

FIELD AND BACKGROUND OF THE INVENTION

The present invention relates, in general, to steam condensers with temperature regulating apparatus and in particular to a new and efficient steam condenser having an apparatus that is positioned outside of the heat exchanger bundles or sections of the steam condenser whereby articulated electrically heated blankets or electrically heated panels are used to provide a freeze proof environment in the steam condenser system during times of low temperatures.

U.S. Pat. No. 4,450,899 discloses a method and apparatus for regulating outdoor steam condensers whereby a roll-shutter is employed outside of and at a distance from the steam condenser for rolling shutters to the steam pipeline. Through the implementation of a roll-shutter system, a recirculation channel is created for the heated air leading to the condensation conduits and serves as a means for avoiding problems in connection with freezing at low outer environment temperatures.

Another approach is the use of screening elements such as flaps or louvers which serve both as a means to protect the steam condenser from the outside elements of the environment and as an apparatus for channeling heated air from the steam condenser over portions of the condenser that are subject to freezing.

During cold weather operation of an air cooled vapor or steam condenser, the danger of water freezing in the drain lines remains a significant problem and contributes to inefficient operation in the heat exchanger sections.

Although both the roll-shutter systems and the systems that employ flaps or louvers alleviate some of the freezing that occurs in the steam condensers, they are not total freeze-proof systems and offer marginal protection from freezing at best. Due to the reliance on air recirculation to heat the heat exchanger bundles of the condenser, there is significant inefficiency in the time involved in increasing the condenser operating temperature to a desired level. Also, a temperature uniformity problem persists in that the operators have no control over which sections of the steam condenser will be heated first due to the unpredictability involved in their dependence on the recirculation of air.

SUMMARY OF THE INVENTION

An object of the present invention is to provide a steam condenser with heating apparatus that relies on providing heat electrically to the condenser through the use of electrically heated blankets or electrically heated panels.

According to the present invention, the electric heat apparatus can be motor activated and rolled up and down along the outside of the steam condenser.

In utilizing articulated electrically heated blankets or panels, a highly efficient means is provided to assure total freeze proof protection of the steam condenser. A steam condenser operator has full control of temperature regulation at his fingertips, and by simply and easily increasing the amount of electrical current into the articulated electrically heated blanket or panel, full freeze-proof protection is assured instead of having to rely on the unpredictability of flowing air currents.

The operating temperature of the steam condenser can be regulated uniformly by heating the blankets and panels electrically. This prevents any variation in temperature between the numerous heat exchanger bundles. Such variations in temperature can lead to condensate freezing in some of the heat exchanger bundles.

In addition, electrically heated blankets and panels reduce the amount of time it takes to heat the heat exchanger bundles due to the ultimate quickness involved in an electric delivered heating system.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

Figure 1:
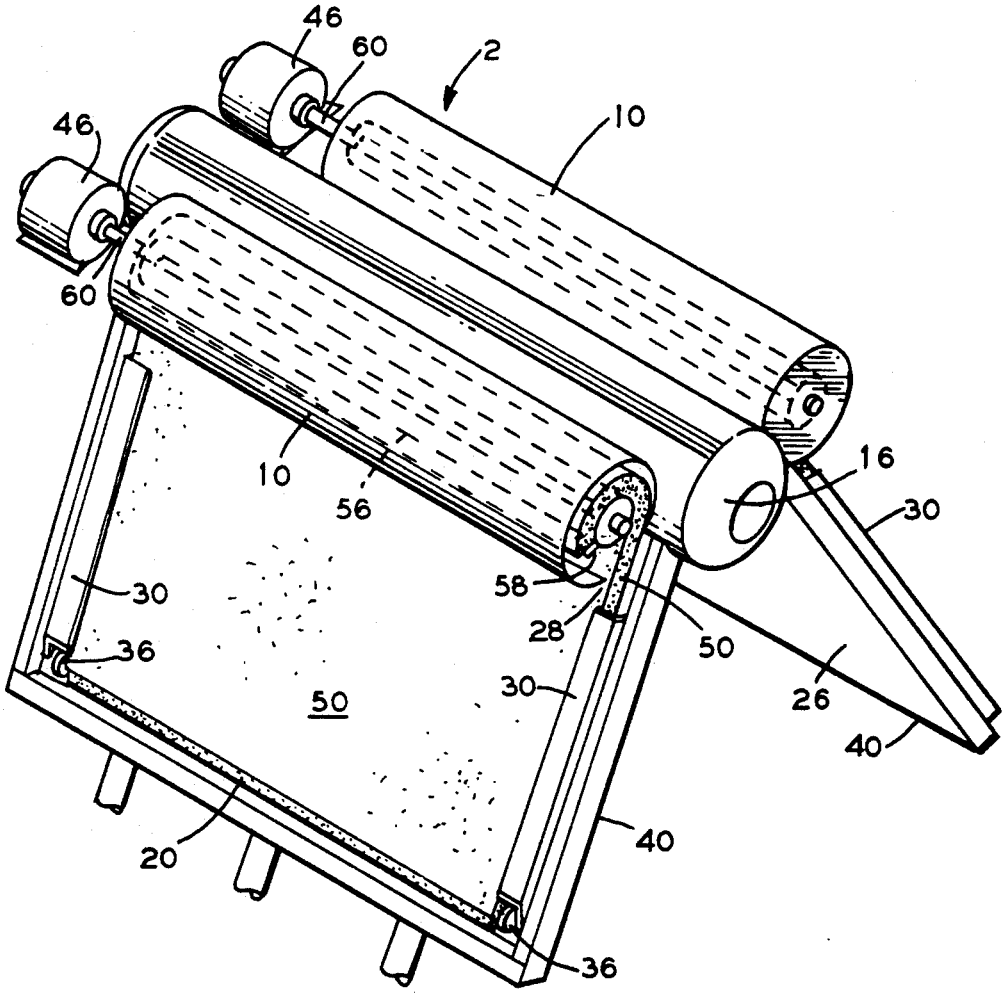
FIG. 1 is a schematic perspective view of a steam condenser with the electrically heated blankets fully extended and covering the heat exchanger bundles of the condenser according to the invention.

Referring to FIGS. 1 through 10, the same reference numerals are utilized to designate functionally similar parts.

Referring to FIG. 1 in particular, the invention embodied therein comprises a vapor or steam condenser with an electric heat apparatus 2 and a horizontally positioned cylinder forming an inlet header 16, positioned above the ground and including heat exchanger bundles 26 and appropriate support structure in the form of a large "A" frame.

Blanket casings 10 which store electrically heated blankets 50 are attached to, and positioned parallel across the top of inlet header 16.

A guide rail 30 is positioned over the heat exchanger bundles 26 and is connected to the inlet header 16 and blanket casing 10. The guide rail 30 runs lengthwise and parallel to the outer edge of the first and last heat exchanger bundle 26 and is supported by a frame base 40.

Figure 5:
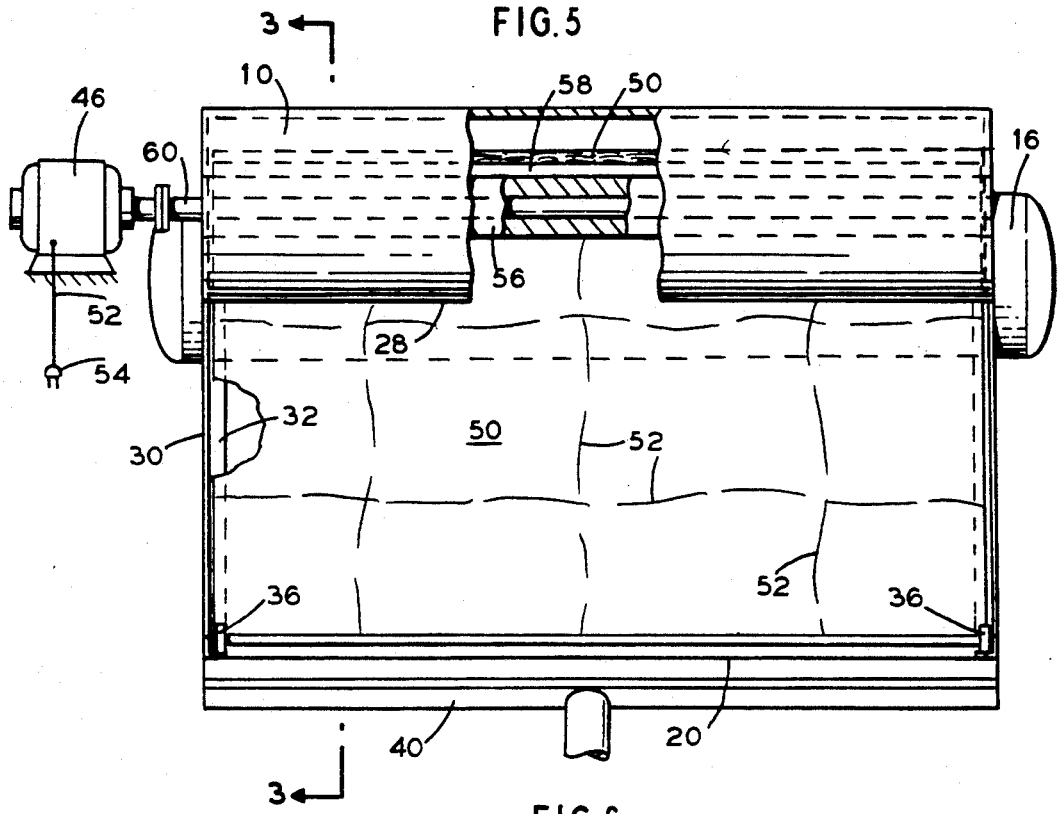
FIG. 5 is a side elevation view of the electric heat blanket apparatus with the blanket fully extended and covering the heat exchanger bundles.

The guide rail 30 is grooved throughout in order to allow the guides 36 which anchor and secure the electrically heated blanket 50 to slide uniformly in the guide rail grooves 32, shown at FIG. 5, as it is moved to a covered or uncovered position.

Blanket edge 20 runs parallel to the frame base 40 and is comprised of a weighted material such as lead in order to keep electrically heated blanket 50 from separating from the guide rail 30.

Referring also to FIG. 5 in particular, blanket casing 10 houses electrically heated blanket 50 which is driven by a propelling shaft 60, the latter being powered by a motor 46. The shaft 60 is connected to motor 46 and is positioned through the diameter of the blanket casing 10, and runs parallel with the blanket casing 10.

The propelling shaft 60 is encompassed 360° by the spindle 56 and causes the spindle 56 to rotate when driven by the motor 46.

The spindle 56 serves as the axle from which the electrically heated blanket 50 is spooled and unspooled in order to regulate the exposure and temperature of the heat exchanger bundles. The electrically heated blanket 50 is attached to the spindle 56 by the spindle connection 58.

The blanket casing aperture 28, which is an opening extending the entire length of the blanket casing 10, allows for the electrically heated blanket 50 to move from its stored position in the blanket casing 10 to the grooves 32 in guide rail 30.

The electrically heated blanket 50 is comprised of an insulating material capable of holding electric heat generated from an electrical source 54 which is carried through the motor 46 by means of electric wire 52. Electric wire 52 is located within the propelling shaft 60 and leads into various portions of the electrically heated blanket 50. The electrical source 54 provides electric heat to the blanket 50 through the electric wire 52. The temperature of the bundles 26 is controlled by varying the position of the blanket 50 over the bundles 26 while electric heat is provided to the blanket 50 from the electric wire 52 originating at the electric source 54.

Figure 2:
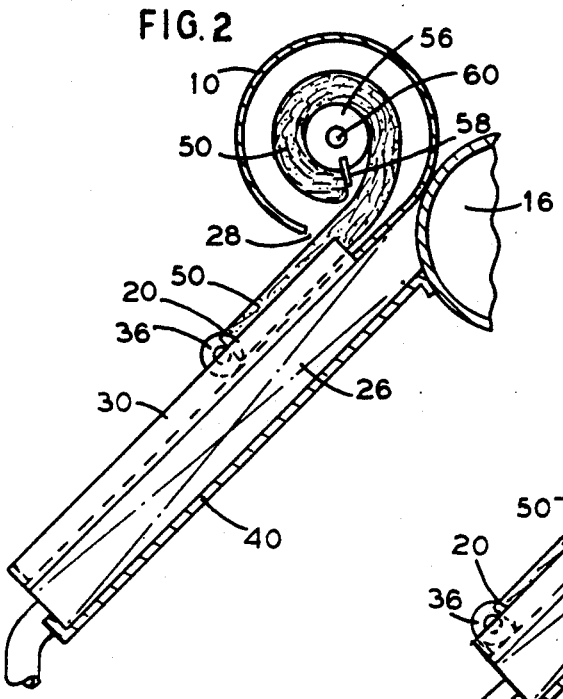
FIG. 2 is a front elevation view of part of the condenser with the electrically heated blanket partially extended and covering a portion of the heat exchanger bundles.
Figure 3:
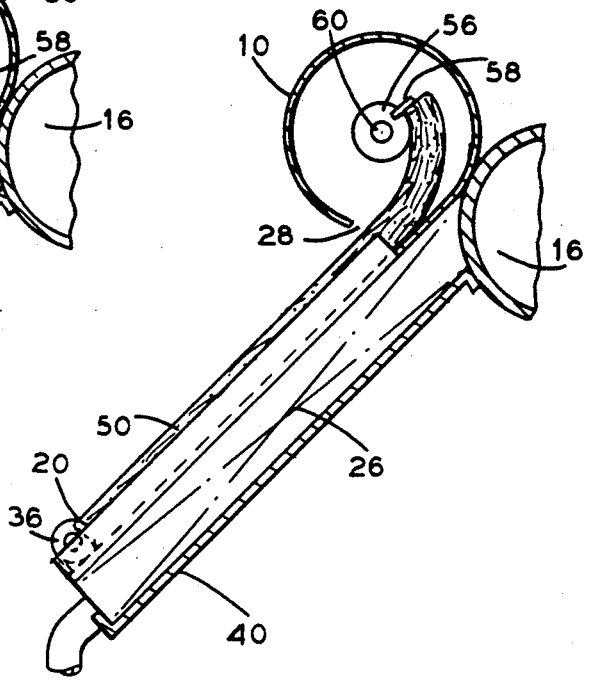
FIG. 3 is a view similar to FIG. 2 with the electrically heated blanket fully extended and covering the heat exchanger bundles.
Figure 4:
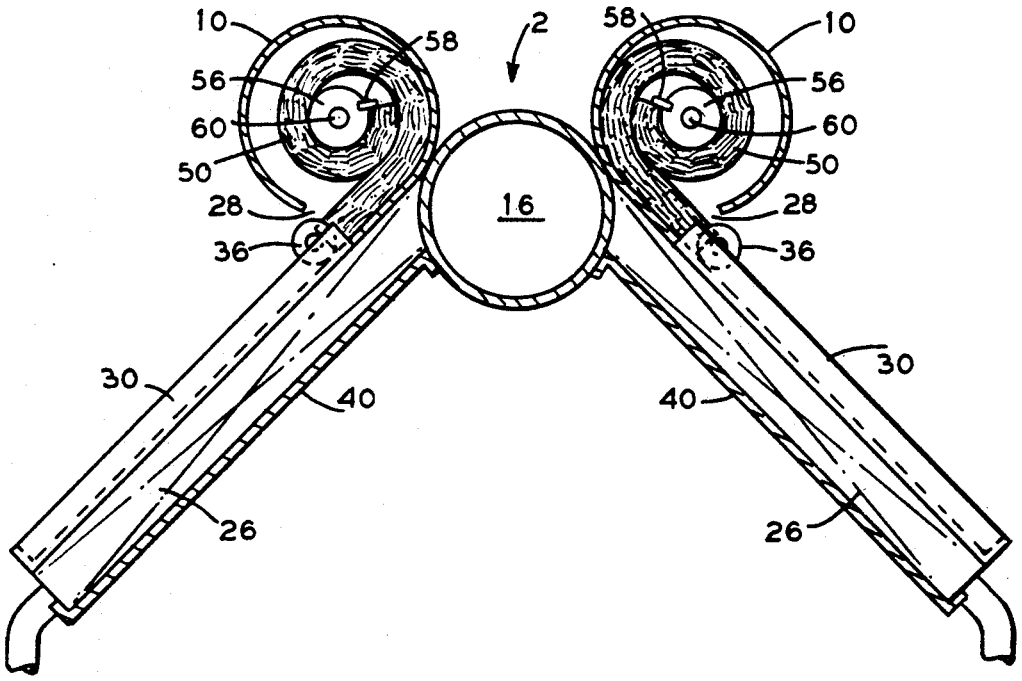
FIG. 4 is a front elevation view of the condenser with the electrically heated blankets spooled, thus exposing the heat exchanger bundles to the outside environment.

As shown in FIGS. 2 and 3, the electrically heated blanket 50 is designed to be unspooled or extended onto an exposed surface of the condenser and, when not in use, spooled into the casing 10. FIG. 4 shows the spooled or retracted position with all heat exchanger bundles 26 exposed to the environment.

Figure 6:
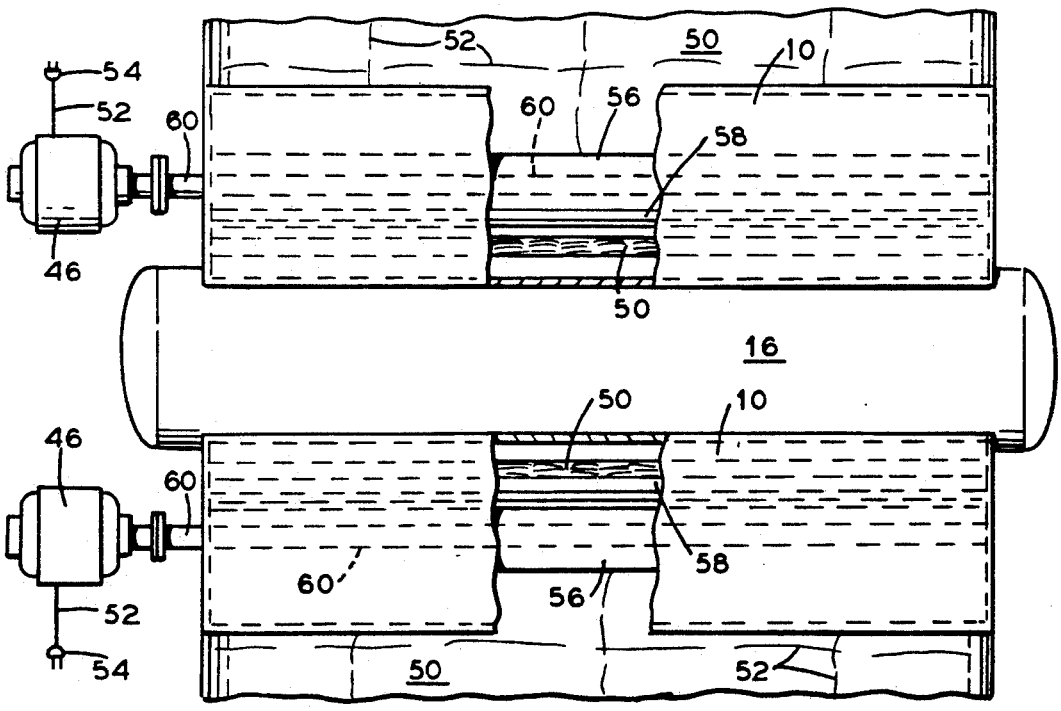
FIG. 6 is a top plan view of the steam condenser with its electric heat blanket apparatus in place.

FIG. 6 depicts the steam condenser with the electric heat apparatus 2 as viewed from the top and including the inlet header 16, the blanket casings 10, the electrically heated blankets 50, the electric wires 52 and the propelling shafts 60.

Figure 7:
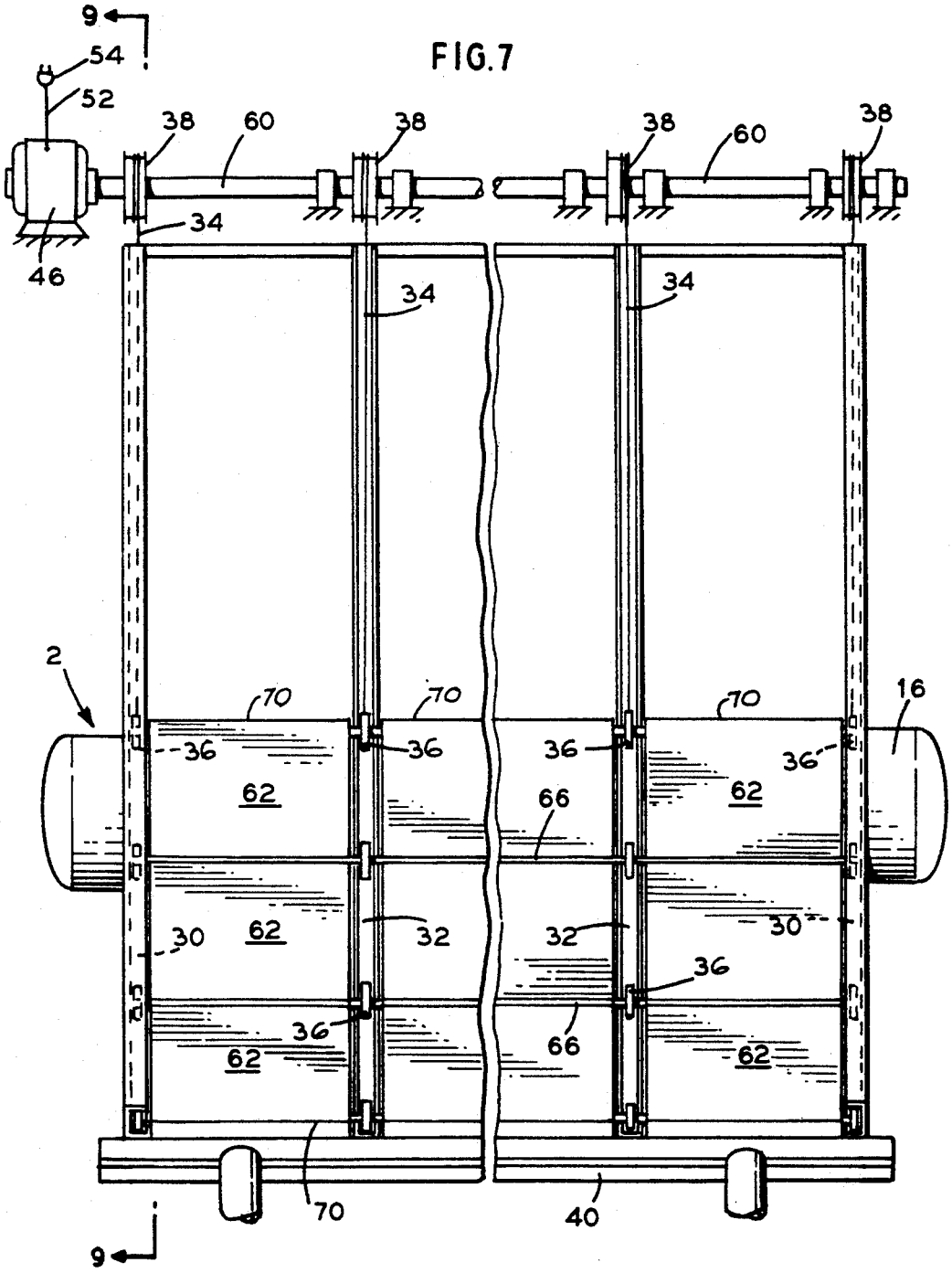
FIG. 7 is a side elevation view of an alternate embodiment of the invention utilizing electrically heated panels fully extended and covering the heat exchanger bundles.

FIG. 7 shows an alternate embodiment of the invention utilizing electrically heated panels 62 instead of the electrically heated blanket 50. The electrically heated panels 62 are depicted in a plurality of sections where each section is joined by a panel joint 66. At each panel joint 66 and panel edge 70 of the electrically heated panels 62 are guides 36 which ride along the grooves 32 set into the guide rail 30.

The guide rail 30 extends from the frame base 40 upwardly while running parallel to the heat exchanger bundles 26 and extending above the inlet header 16.

The movement of the electrically heated panels 62 is controlled through the employment of guide wires 34 which are connected to the guide wire spools 38 located at the most upward point of the guide rail 30.

Each guide wire spool 38 encompasses the propelling shaft 60 so that, as the propelling shaft 60 is rotated by the motor 46, each guide wire spool 38 will rotate synchronously with the propelling shaft 60.

The rotation of the guide wire spools 38 through the propelling shaft 60 enables the guide wires 34 to spool or unspool from the guide wire spools 38 and thus regulate the movement of the electrically heated panels 62. The guide wire 34 is held taut between its connection to the guide wire spool 38 and the guide 36.

The electrically heated panels 62 can be heated through the use of an electrical charge that is carried from the electrical source 54 through the motor 46 and propelling shaft 60 through an electrical wire 52 that extends to the heating panel edge 70 through the guide rail 30.

Figure 8:
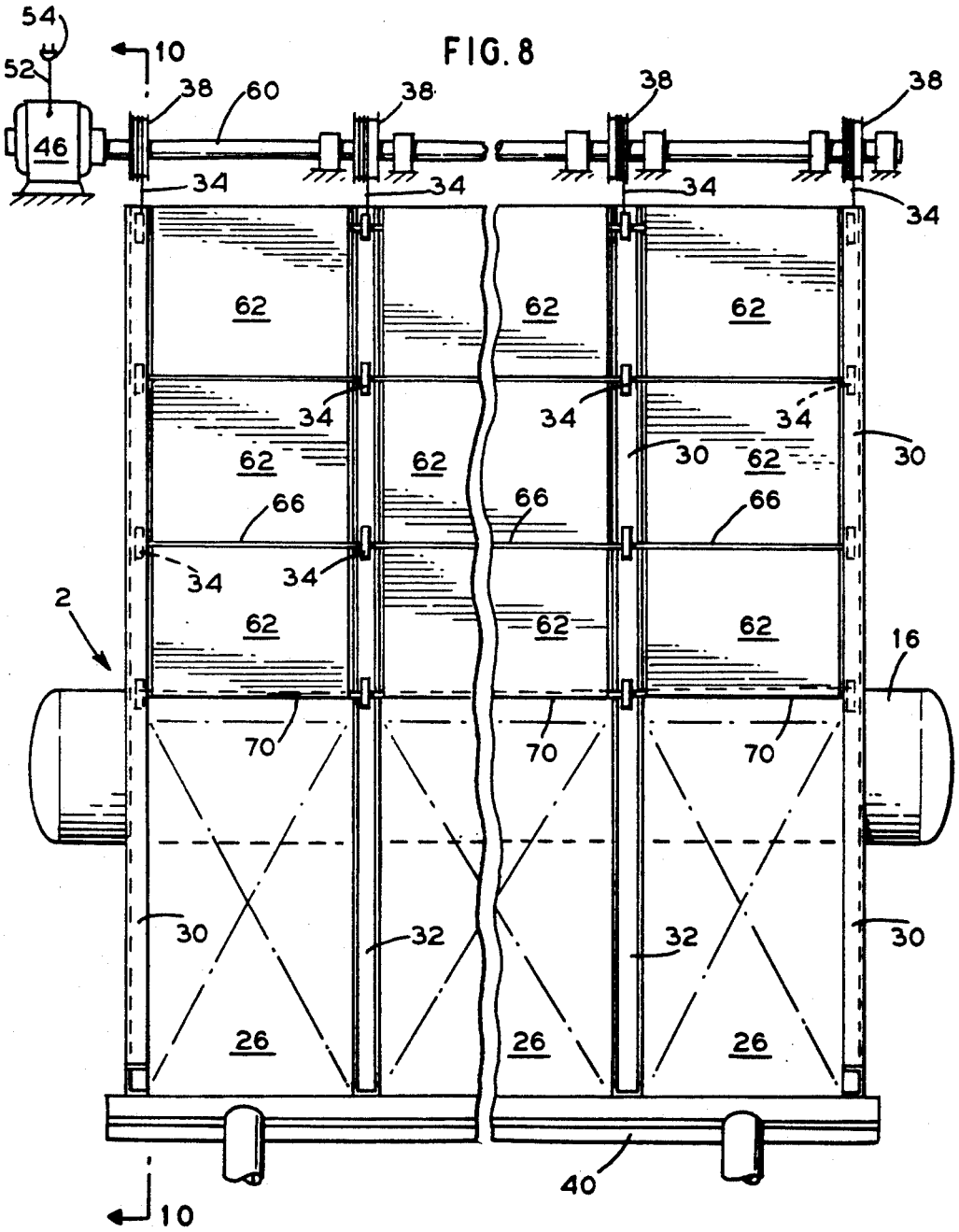
FIG. 8 is a side elevation view of the alternate embodiment with the electrically heated panels fully retracted thereby exposing the heat exchanger bundles.
Figure 10:
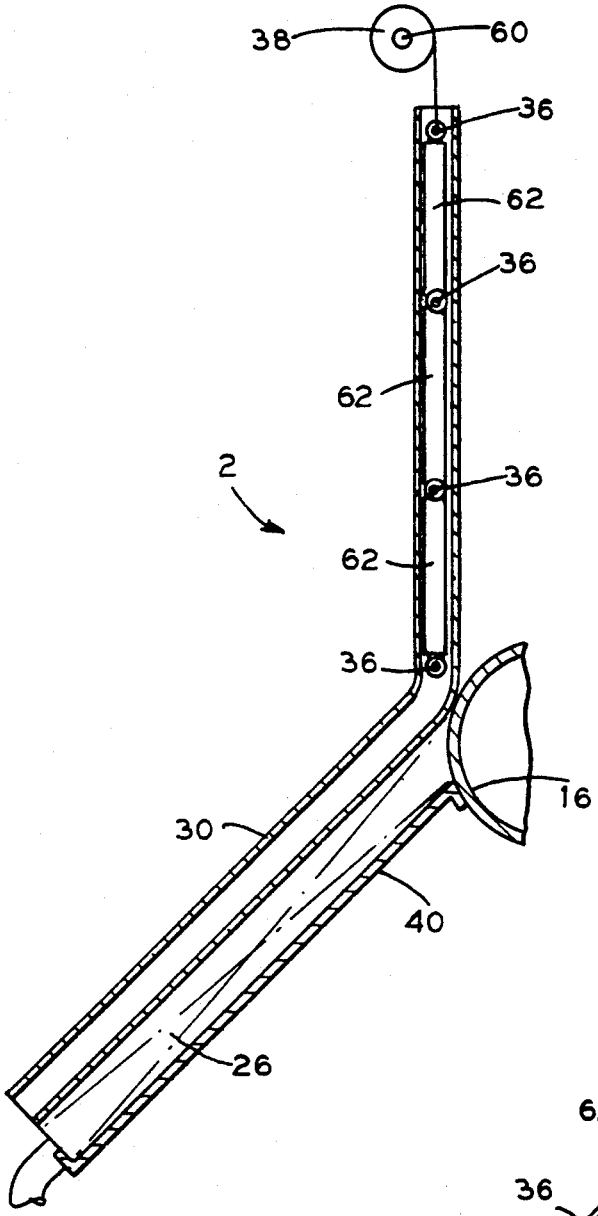
FIG. 10 is a partial front elevation view of the alternate embodiment with the electrically heated panels fully retracted thereby exposing the heat exchanger bundles.
Figure 9:
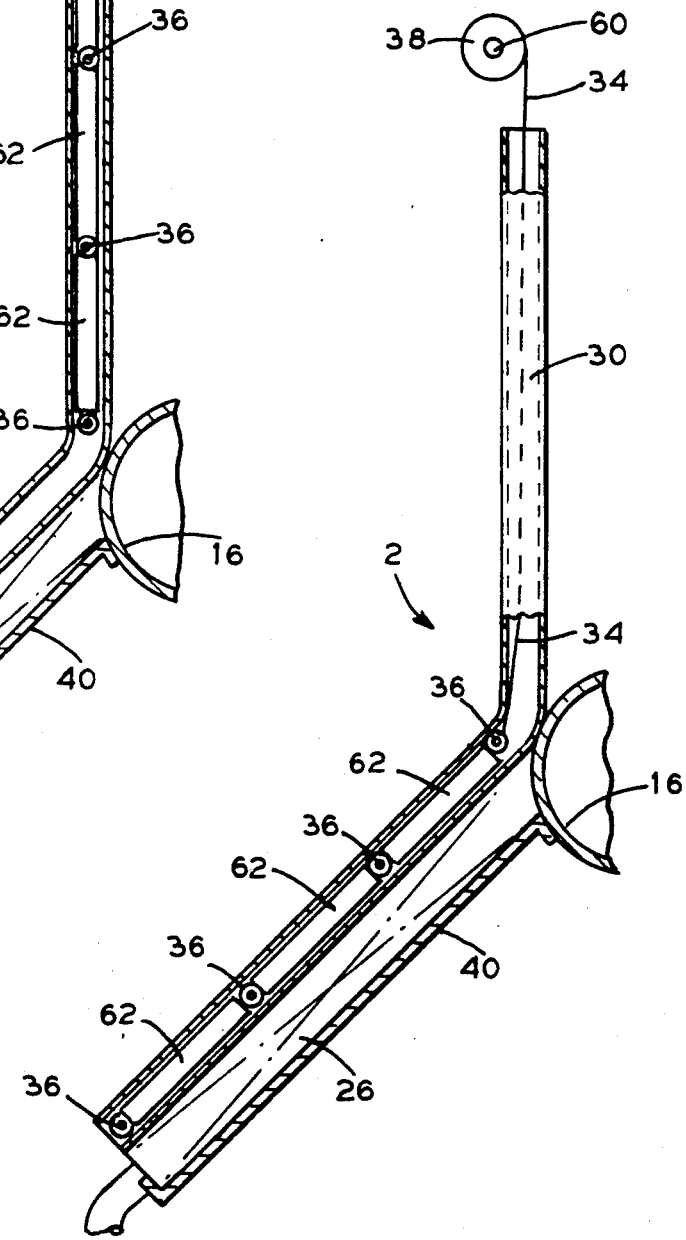
FIG. 9 is a partial front elevation view of the alternate embodiment with the electrically heated panels fully extended and covering the heat exchanger bundles.

FIGS. 7 and 9 show the embodiment of the invention having electrically heated panels 62 in the position covering the heat exchanger bundles 26, and FIGS. 8 and 10 show the embodiment with the electrically heated panels 62 in a stored position thereby exposing the heat exchanger bundles 26.

While specific embodiments of the invention have been shown and described in detail to illustrate the application of the principles of the invention, it will be understood that the invention may be embodied otherwise without departing from such principles.

What is claimed is:

1. A steam condenser arrangement with temperature regulating apparatus comprising:

a condenser having an exposed surface with an upper portion and a lower portion for allowing outside air to come into contact with the condenser;

heating control means connected to the condenser for regulating the temperature of the condenser;

mounting means connected to the condenser for positioning the heating control means over the exposed surface of the condenser in one of a covered, uncovered and partially covered position, the mounting means including a set of grooves and the heating control means being channeled through the grooves and over the exposed surface; and guiding means connected to front ends of the heating control means for guiding the heating control means along the set of grooves.

2. An arrangement according to claim 1, including motor means connected to the condenser for powering the heating control means into a covered, uncovered, and partially covered position.

3. An arrangement according to claim 1, including electrical means connected to the motor means for carrying electrical current to the heating control means for regulating the temperature of the condenser.

4. An arrangement according to claim 2, including spindle means connected to the motor means for extending and retracting the heating control means.

5. An arrangement according to claim 1, including casing means connected to the condenser at the upper portion of the exposed surface for housing the heating control means.

6. An arrangement according to claim 1 wherein the heating control means is formed of a plurality of blankets.

7. An arrangement according to claim 1 the heating control means is formed of a plurality of heating panels.

8. A steam condenser arrangement with temperature regulating apparatus comprising:

a condenser having an exposed surface with an upper portion and a lower portion for allowing outside air to come into contact with the condenser;

heating control means connected to the condenser for regulating the temperature of the condenser;

mounting means connected to the condenser for positioning the heating control means over the exposed surface of the condenser in one of a covered, uncovered, and partially covered position;

motor means connected to the condenser for powering the heating control means into the covered, uncovered, and partially covered position; and electrical means connected to the motor means and the heating control means for carrying electrical current to the heating control means for regulating the temperature of the condenser.

9. An arrangement according to claim 8, including casing means connected to the condenser at the upper portion of the exposed surface for housing the heating control means.

10. An arrangement according to claim 9, wherein the mounting means includes a set of grooves and the heating control means being channelled through the grooves and over the exposed surface.

11. An arrangement according to claim 10, wherein the mounting means includes guiding means connected to front ends of the heating control means for guiding the heating control means along the set of grooves.

12. An arrangement according to claim 8 wherein the heating control means is formed of a plurality of blankets.

13. An arrangement according to claim 8, the heating control means is formed of a plurality of heating panels.

* * * * *